United States Patent [19]

Barrett

[11] Patent Number: 4,486,895

[45] Date of Patent: Dec. 4, 1984

[54] X-RAY TUBE VOLTAGE INDICATOR

[75] Inventor: Richard L. Barrett, Norwalk, Conn.

[73] Assignee: The Machlett Laboratories, Incorporated, Stamford, Conn.

[21] Appl. No.: 458,415

[22] Filed: Jan. 17, 1983

Related U.S. Application Data

[63] Continuation of Ser. No. 167,997, Jul. 14, 1980, abandoned.

[51] Int. Cl.[3] ..... H05G 1/32

[52] U.S. Cl. ..... 378/98; 378/111

[58] Field of Search ..... 378/98, 111

[56] References Cited

U.S. PATENT DOCUMENTS 2,179,333 11/1939 Horsley ..... 378/98

2,193,071 3/1940 Lee ..... 378/109

2,243,162 5/1941 Lee ..... 378/98

*Primary Examiner*—Alfred E. Smith

*Assistant Examiner*—T. N. Grigsby

*Attorney, Agent, or Firm*—John T. Meaney; Joseph D. Pannone; R. M. Sharkansky

[57] ABSTRACT

An X-ray generator system having control circuitry disposed for applying a selected voltage between cathode and anode electrodes of an X-ray tube and for sending a selected current through the tube during an X-ray exposure, the control circuitry including a voltage indicator network disposed for subtracting from the selected voltage anticipated losses in accordance with the level of selected current to indicate prior to the initiation of the X-ray exposure the actual voltage that will be applied between the cathode and anode electrode during the X-ray exposure.

12 Claims, 1 Drawing Figure

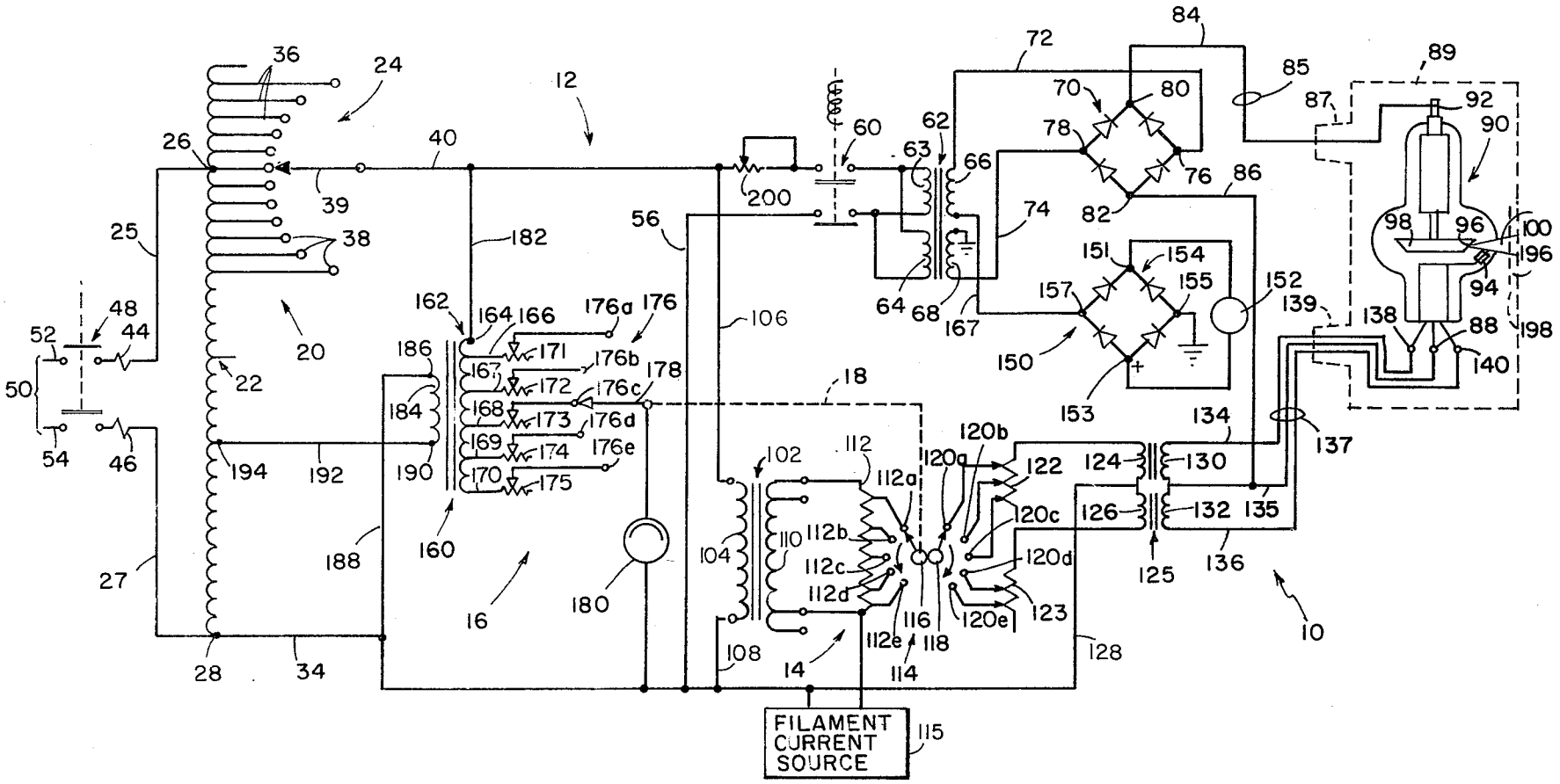
FILAMENT CURRENT SOURCE

X-RAY TUBE VOLTAGE INDICATOR

CROSS-REFERENCE TO RELATED CASES

This is a continuation of application Ser. No. 167,997, filed July 14, 1980, and now abandoned.

BACKGROUND OF THE INVENTION

1. Field of the Invention

This invention relates generally to X-ray generator systems and is concerned more particularly with X-ray tube control circuitry having means for indicating prior to operation of the tube the actual voltage applied between electrodes of the tube when the tube is operated.

2. Discussion of the Prior Art

A conventional X-ray tube type of X-ray generator system generally includes control circuitry having a polarized source of high voltage, such as the rectified output of a high voltage transformer, for example, disposed for applying a suitable high voltage between the cathode and anode electrodes of the X-ray tube. In operation, electrons emitted from the cathode are beamed electrostatically onto a focal spot area of an anode target with sufficient energy to generate X-rays which emanate from the tube in a beam. The maximum energy of X-rays in the beam is proportional to the maximum kinetic energy attained by the beamed electrons, which is a function of the voltage applied between the cathode and anode electrodes during operation of the tube.

In diagnostic radiology, for example, the X-ray beam may be directed through a selected portion of a patient and onto an aligned film to produce an X-ray shadow image of internal body structure in the selected portion. Consequently, if the selected portion is comprised of fleshy tissue, the voltage applied between the cathode and anode electrodes of the X-ray tube is relatively low in value in order to generate correspondingly low energy or "soft" X-rays. The soft X-rays have sufficient energy to penetrate through the fleshy tissue in the selected portion and produce on the aligned film an X-ray image having the desired resolution and contrast for defining detail structure, such as small blood vessels, for example. Conversely, if the selected portion is comprised of bony structure, the voltage applied between the cathode and anode electrodes is relatively high in value in order to generate correspondingly high energy or "hard" X-rays. The hard X-rays have sufficient energy to penetrate through the bony structure and produce on the aligned film an X-ray image having the necessary resolution and contrast for showing fine details, such as hairline cracks, for example.

Consequently, X-ray tube control circuitry of the prior art generally is provided with means for selecting and indicating the desired voltage to be applied between the cathode and anode electrodes of the tube during a planned X-ray exposure. The voltage selecting and indicating means of the prior art preferably is disposed for connection to the input primary rather than the output secondary of the high voltage transformer in order to avoid the high voltages applied between the cathode and anode electrodes during operation of the tube. However, it may be found that when an X-ray exposure is initiated there is a considerable drop in voltage which causes the actual voltage applied between the cathode and anode electrodes to be substantially less than the desired voltage. As a result, the X-rays generated may not have sufficient energy to penetrate through the selected portion of the patient and produce an X-ray image of sufficient clarity to form the basis of an accurate diagnosis of the patient's condition. Thus, the selected value of voltage may have to be increased; and the patient may be required to undergo additional X-ray exposures until the proper value of voltage less the voltage drop is found for producing a clear X-ray image of the internal body structure. These additional X-ray exposures generally are contrary to the requirements of public health laws which are intended to protect the patient from exposure to excessive X-radiation.

SUMMARY OF THE INVENTION

Accordingly, these and other disadvantages of the prior art are overcome by this invention which comprises an X-ray tube type of X-ray generator system having control circuitry provided with voltage indicator means for indicating prior to an X-ray exposure the actual voltage that will be applied between the cathode and anode electrodes of the X-ray tube during the X-ray exposure.

The control circuitry includes a voltage supply circuit comprising an adjustable voltage source having a voltage select switch and connected through a pair of contacts of an activator switch to the primary winding of a high voltage transformer. The secondary winding of the high voltage transformer is connected through a rectifier bridge network to the cathode and anode electrodes of the X-ray tube for applying a selected voltage therebetween when the activator switch is actuated to initiate an X-ray exposure. The control circuitry also includes a current supply circuit having a current select switch connected to the primary winding of a filament transformer which has a secondary winding connected to the cathode of the X-ray tube for sending a selected current through the tube which the X-ray exposure is initiated.

The voltage indicating means comprises a voltage subtractive network having one end connected electrically to the output of the voltage source in the portion of the voltage supply circuit preceding the activator switch for sensing the voltage initially applied by the adjustable voltage source prior to initiation of the X-ray exposure. The voltage subtractive network is connected to a series of fixed contacts in a resistor select switch having a movable contact arm coupled to the current select switch in the current supply circuit. Thus, a particular fixed contact of the resistor select switch is selected in accordance with the selected value of current to subtract from the initially applied voltage, losses which will occur when the X-ray exposure is initiated. As a result, a voltage indicator device connected in electrical series with the movable contact arm of the resistor select switch indicates prior to initiation of the X-ray exposure the actual voltage that will be applied between the cathode and anode electrodes of the X-ray tube during the X-ray exposure.

BRIEF DESCRIPTION OF THE DRAWING

For a better understanding of this invention, reference is made in the following more detailed description to the drawing wherein there is shown a schematic view of an X-ray generator system embodying the invention.

DESCRIPTION OF THE PREFERRED EMBODIMENT

Referring to the drawings wherein like characters of reference designate like parts, there is shown an X-ray generator system 10 having control circuitry including a voltage supply circuit 12, a current supply circuit 14, and a voltage indicator means 16 which is connected electrically to the voltage supply circuit 12 and is coupled, as denoted by dashed line 18, to a portion of the current supply circuit 14.

The voltage supply circuit 12 includes an adjustable voltage source 20 comprising an autotransformer 22 and a voltage select switch 24. Adjustable voltage source 20 has a pair of input conductors, 25 and 27, respectively, connected electrically to respective primary terminals 26 and 28 of the autotransformer 22. The terminal 28 may comprise a zero voltage or electrical ground terminal which constitutes one of the autotransformer secondary terminals and is connected electrically to an output conductor 34 of the adjustable voltage source 20. The autotransformer winding has an opposing end portion provided with a plurality of secondary voltage taps 36 which are connected electrically to respective fixed contacts 38 of the voltage select switch 24. Switch 24 has a movable contact arm 39 which sequentially engages each of the fixed contacts 38 in an electrically conductive manner, and is electrically connected to another output conductor 40 of the adjustable voltage source 20.

The input conductors 25 and 27 of source 20 are electrically connected through respective fuses 44 and 46 to respective contacts of a push-button power switch 48. When switch 48 is actuated to the "Power On" position, the input conductors 25 and 27 are electrically connected to respective conductors 52 and 54 of an input power line 50 which applies an alternating voltage, such as two hundred and twenty volts relative to zero voltage terminal 28, for example, along the winding of autotransformer 22 between primary terminals 26 and 28, respectively. As a result, an alternating current flows from the input power line 50 and through the primary portion of autotransformer 22 to establish along the secondary voltage taps 36 an alternating voltage having instantaneous values which increase progressively in magnitude as a function of distance from the zero voltage terminal 28. Consequently, the voltage taps 36 apply to the fixed contacts 38 of switch 24 a graduated series of alternating voltages having respective instantaneous values which increase in magnitude from one end of the arcuate array of contacts 38 to the other end thereof, such as from about one hundred and ninety-five volts to about two hundred and seventy-five volts, for example. Anyone of the voltage values in the graduated series may be selected by moving the contact arm 39 into electrical engagement with a respective fixed contact 38 to which the desired voltage value is applied. Thus, the selected voltage value is applied through the contact arm 39 to the output conductor 40, and is relative to the zero voltage value on the other output conductor 34 connected to terminal 28 of adjustable voltage source 20.

The output conductor 40 and the output conductor 34 via a conductor 56 are electrically connectable through respective contacts of an activator switch 60 to respective primary terminals of a conventional high voltage transformer 62. Consequently, when the activator switch 60 is closed to initiate and X-ray exposure, primary windings 63 and 64, respectively, are electrically connected in parallel between the output conductors 40 and 34, such that the selected voltage is applied along each of the primary windings 63 and 64, respectively. As a result, there is induced in secondary windings, 66 and 68, respectively, of transformer 62 an alternating voltage which is increased or stepped up relative to the selected voltage by a predetermined ratio relationship, such as six hundred to one, for example. The secondary windings 66 and 68 have opposing terminal end portions connected through respective conductors 72 and 74 to input terminals, 76 and 78, respectively, of a conventional bridgetype rectifier 70. Consequently, the rectifier 70 rectifies the high alternating voltage induced in the secondary windings 66 and 68 of transformer 62 and applies to its respective output terminals 80 and 82 a correspondingly high polarized voltage, such as one hundred and twenty-five kilovolts, for example. Thus, the high polarized voltage applied to the respective output terminals 80 and 82 of rectifier 70 is directly related to the selected voltage applied to the respective output conductors 40 and 34 of adjustable voltage source 20.

Connected electrically to the output terminals 80 and 82 of rectifier 70 are respective conductors 84 and 86. The conductor 84 is routed through a conventional cable 85 which may be relatively long, such as twenty to thirty feet, for example. The cable 85 terminates in a suitable connector for mating with a typical horn-type connector 87 of a conventional X-ray generator housing 89 wherein a conventional X-ray tube 90 is disposed. Accordingly, within the X-ray generator housing 89, conductor 84 is electrically connected to an anode terminal 92 of the X-ray tube 90. The X-ray tube 90 may be of the rotating anode type having an electron emitting cathode 94 disposed for electrostatically beaming emitted electrons onto a focal spot area 96 of a rotating anode target 98 with sufficient energy to generate X-rays which emanate from the X-ray tube 90 in a beam 100.

The current supply circuit 14 of X-ray generator system 10 comprises a current supply transformer 102 having a primary winding 104 with terminal ends connected electrically to respective input conductors 106 and 108. The input conductors 106 and 108 are connected to respective output conductors 40 and 34 of adjustable voltage source 20 to apply the selected voltage along the primary winding 104 of transformer 102. As a result, there is induced in secondary winding 110 of transformer 102 an alternating voltage which is impressed along a parallel connected voltage dropping resistive element 112. An opposing alternating voltage having instantaneous values of greater magnitude is impressed in the opposite direction along the voltage dropping resistive element 112 by a filament current source 115 having one terminal connected electrically to the zero voltage conductor 34 and another terminal connected to the lower end portion of resistive element 112. Thus, the current supply transformer 102 provides a bucking voltage along resistive element 112 for decreasing the voltage impressed along resistive element 112 by the current supply source 115 in accordance with the selected voltage applied to conductors 40 and 34, respectively, by adjustment of the switch 24 in voltage source 20.

The resistive element 112 is provided with a series of spaced taps which are electrically connected to respective fixed contacts **112*a*–112*e*** of a current select switch 114. Switch 114 may be provided with a movable pair of cooperating contact arms 116 and 118 which rotate in mutually opposing directions. Thus, an operator may rotate the arm 116 counterclockwise thereby causing the arm 118 to rotate clockwise, as viewed in the drawing, for example. As a result, the rotating arm 116 sequentially engages fixed contacts 112*a*–112*e*, respectively, while the oppositely rotating arm 118 sequentially engages fixed contacts 120*a*–120*e*, respectively, of the current select switch 114.

The fixed contacts 120*a*–120*c* are electrically connected to respective adjustable taps on a voltage dropping resistor 122 which has a terminal end connected to a primary winding 124 of a filament supply transformer 125. Fixed contacts 120*d* and 120*e* are electrically connected to respective adjustable taps on a voltage dropping resistor 123 which has a terminal end connected to another primary winding 126 of the filament supply transformer 125. The respective primary windings 124 and 126 are connected in electrical series with one another; and the resulting junction is electrically connected to a center tap conductor 128 which is electrically connected to the zero voltage or electrical ground conductor 34.

The filament supply transformer 125 has a pair of series connected secondary windings 130 and 132 which have terminal end portions connected to respective conductors 134 and 136. The junction of the series connected windings 130 and 132 is connected to a secondary center tap 135 which also is connected to output conductor 86 of high voltage rectifier 70. The conductors 134–136 also are routed through a conventional cable 137, which may have a relatively long length, such as twenty to thirty feet, for example, and terminate in a suitable connector which mates with another typical horn type connector 139 of the X-ray generator housing 89. Accordingly, within the generator housing 89, the conductors 134 and 136 are electrically connected to respective cathode terminals 138 and 140; and the secondary center tap conductor 135 is electrically connected to a cathode terminal 88.

The fixed contacts 112*a*–112*e* of current select switch 114 correspond to respective levels of milliampere current, such as three hundred, two hundred, one hundred and fifty, one hundred, and fifty milliamperes, for example, which may be selected to flow through X-ray tube 90 during an X-ray exposure. Thus, the current select switch contact arm 116 may be rotated by an operator to engage the fixed contact 112*b*, for example, which will simultaneously rotate the contact arm 118 in the opposing angular direction to engage the fixed contact 120*b*. As a result, the voltage applied to fixed contact 112*b* is applied through the electrically connected contact arms 116–118 and the adjustable tap of resistor 122 to the connected primary terminal of filament supply transformer 125. Consequently, a corresponding current flows through primary winding 124 of filament supply transformer 125 and induces in the secondary winding 130 a current which causes the cathode 94 of X-ray tube 90 to emit sufficient electrons for sending a two hundred milliampere current flowing through the tube 90 during an X-ray exposure.

Accordingly, the X-ray generator system 10 may include a current indicating means 150 comprising a milliammeter 152 connected across respective opposing terminals of 151 and 153 a conventional bridge-type rectifier 154. The rectifier 154 has a third terminal 155 connected to electrical ground and an opposing fourth terminal 157 connected through a conductor 167 to a terminal end portion of high voltage secondary winding 66 adjacent an electrically grounded end portion of high voltage secondary winding 68. Thus, the current flowing through X-ray tube 90 is directed to electrical ground through the milliammeter 150 thereby providing a reading indicative of the value of current flowing through tube 90.

The voltage indicating means 16 includes a voltage compensator transformer 160 having a secondary winding 162 provided with an end terminal 164 and a plurality of spaced taps 166, 167, 168, 169, and 170, respectively. Secondary taps 166–170 are connected electrically to terminal end portions of respective adjustable resistors 171, 172, 173, 174, and 175, each of which has an adjustable tap connected electrically to a respective fixed contacts 176*a*–176*e* of a voltage compensator select switch 176. The voltage compensator select switch 176 has a movable contact arm 178 which sequentially engages each of the fixed contacts 176*a*–176*e* and is coupled mechanically, as denoted by dashed line 18, to the contact arm 116 of current select switch 114 for corresponding movement therewith. The contact arm 178 of voltage compensator select switch 176 is connected electrically to output conductor 34 through a peak reading voltmeter 180 which indicates the voltage, in kilovolts, applied between the cathode terminal 88 and the anode terminal 92 of X-ray tube 90.

End terminal 164 of secondary winding 162 is electrically connected through a conductor 182 to the output conductor 40 of adjustable voltage source 20. As a result, the selected alternating voltage, which typically may have a value in the range of about one hundred and ninety-five volts to about two hundred and seventy-five volts, for example, is impressed along the secondary winding 162. Accordingly, the selected alternating voltage thus applied along secondary winding 162 has instantaneous values which have a maximum magnitude adjacent the end terminal 164 and decrease steadily in magnitude as a function of distance from end terminal 164 along secondary winding 162. However, the selected voltage impressed along secondary winding 162 is opposed by a bucking voltage which is induced in secondary winding 162 of transformer 160 in a direction opposite to the direction the selected voltage is applied along secondary winding 162.

Thus, adjacent the end terminal 164 of secondary winding 162, the primary winding 184 has an end terminal 186 which is electrically connected through an input conductor 188 to the output conductor 34 of adjustable voltage source 20. An opposing end terminal 190 of primary winding 184 is electrically connected through another input conductor 192 to a tap 194 on autotransformer 22. The tap 194 may be fixed or slidable, and electrically contacts a portion of autotransformer 22 for applying along the primary winding 184 an alternating voltage, such as one hundred and twenty volts, for example, which is less than any of the alternating voltage selectable by the switch 24. As a result, there is induced in the secondary winding 162 of transformer 160 a bucking alternating voltage which is in-phase with the impressed selected voltage but is in the opposite direction along secondary winding 162. Accordingly, the induced bucking voltage has instantaneous values which are maximum in magnitude adjacent the tap 170 and decrease steadily in magnitude as a function of distance therefrom along secondary winding 162.

The compensator transformer 16 preferably is of the voltage step-down type, such as three-to-one, for example, for inducing in the secondary winding 162 a bucking alternating voltage having a value, such as forty volts, for example, which is less than the selected voltage impressed along secondary winding 162. Consequently, along the secondary winding 162, instantaneous values of the induced bucking voltage are subtracted from corresponding instantaneous values of the in-phase selected voltage. However, since the bucking voltage is applied along secondary winding 162 in a direction opposite the selected voltage, the lower magnitude instantaneous values of the bucking voltage adjacent end terminal 164 are subtracted from the higher magnitude instantaneous values of the selected voltage. Also, in the end portion of secondary winding 162 adjacent the tap 170, the higher magnitude instantaneous values of the induced bucking voltage are subtracted from the lower magnitude instantaneous values of the selected voltage. Accordingly, the overall subtractive effect of the induced bucking voltage is to provide a steeper decrease in the selected voltage along the secondary winding 162. This decrease corresponds to the effect of losses occurring within the generator system 10, such as caused by the impedences of high voltage transformer 62, high voltage bridge rectifier 70, the X-ray tube 90, and the relatively long connecting cables used with described apparatus.

The taps 166–170 preferable are factory-adjusted with respect to the secondary winding 162, while the entire generator system 10 is assembled and connected to the X-ray tube 90 as described. A calibration standard voltmeter (not shown) may be connected directly across the cathode terminal 88 and the anode terminal 92 of the X-ray tube 90 to provide readings of actual voltage applied between the cathode 94 and the anode target 98 while the tube 90 is operating under various selectable voltage and current conditions. Consequently, it is important that adequate safeguards be provided, such as placing a lead plug 196 in the port 198 of the X-ray generator housing 89 for example, to protect personnel in the area. The actual voltage readings, thus obtained, may be used for adjusting the taps 166–170 on the secondary winding 162 to provide the same readings on voltmeter 180 when selecting the same operating conditions, but with the activator switch 60 held in the open position to prevent operation of the X-ray tube 90. Accordingly, the secondary voltage taps 166–170 are electrically connected to respective portions of the secondary winding 162 where the bucking alternating voltage values subtracted from the selected alternating voltage values produces a resultant alternating voltage proportional to the voltage applied between the cathode 188 and anode target 192 of X-ray tube 190 at the initiation of an X-ray exposure.

However, when the X-ray generator system 10 is installed for use in a building, it may be found that voltage regulation in the input power line 50 is inadequate. As a result, there is a considerable drop in the actual voltage applied between the cathode 188 and the anode target 192 during an X-ray exposure. It has been found that this voltage drop is a function of a corresponding drop in line voltage, which is related to the power drawn from the input line 50 and the resistance of the input line. Since the voltage between cathode 188 and anode target 192 is indicated by the reading on voltmeter 180, which is proportional to the current passing through the voltmeter, the reading on voltmeter 180 may be corrected for the anticipated voltage drop in power line 50 by decreasing the current flowing through the voltmeter accordingly. Therefore, there is connected in electrical series with each of the taps 166–170 a respective adjustable resistor 171–175 which can be adjusted to introduce respective voltage drops, at the respective current levels selectable by switch 114. Accordingly, the resistors 171–175 are adjusted to decrease the current flowing through voltmeter 180 in proportion to associated drops in line voltage occurring in input line 50 at the selectable current levels drawn from the input line. As a result the current flowing through the voltmeter 180 by way of switch 176 causes the voltmeter 180 to indicate prior to an X-ray exposure the actual voltage that will be applied between the cathode 188 and the anode target 192 of X-ray tube 190 during the X-ray exposure.

In practice, the load regulation of the input power line 50 may be measured under "full load" and under "no load" conditions to calculate the percentage voltage regulation of input line 50. Then resistor 175 may be adjusted to compensate for the voltage drop occurring under full load of the generator system 10, such as three hundred milliamperes at one hundred and twenty-five kilovolts, for example. Thus, the resistor 175 is adjusted so that the voltmeter 180 reads the full voltage less the percentage loss of voltage which occurs at full load. Since the corresponding levels of current for resistors 171–174 bear a definite ratio relationship to the current level used for adjusting resistor 175, the resistors 171–174 may be adjusted to have resistive values in proportion to the adjusted resistive value of resistor 175.

During installation, if the actual voltages applied between the cathode 94 and the anode target 98 of X-ray tube 90 during an X-ray exposure differ from the values indicated by voltmeter 180 by a fixed amount at all the current levels selectable by switch 114, a variable resistor 200 may be connected in electrical series with the output conductor 40 and activator switch 60. The resistor 200 may be adjusted to reduce the voltage applied between cathode 94 and anode target 98 such that it agrees with the actual voltage indicated by the voltmeter 180. Thus, the adjustment of resistor 200 changes the relationship of the voltage applied between the electrodes of tube 90 relative to the voltage indicated by voltmeter 180 for all the current levels selectable by current switch 114. Alternatively, a similar adjustment for all the settings of the voltage indicating means 16 may be achieved by moving the tap 194 on autotransformer 22 to alter the voltage applied to the primary winding 184 of compensator transformer 160. However, the resulting change in the bucking voltage induced in the secondary winding 162 may not be proportional for all the secondary taps 166–170 as would be the case when adjusting the resistor 200. Consequently, the adjustable resistor 200 in series with output conductor 40 and activator switch 60 is preferred over the technique of moving the tap 194 on autotransformer to achieve a fixed change at all the selectable positions of switch 176.

If a fixed change in the indicated voltage on voltmeter 180 is required at one selectable position of switch 176 for all the selectable voltage positions of switch 24, the respective voltage taps 166–170 on the secondary winding 162 may be moved to effect the desired change. However, if a desired change in the indicated voltage on voltmeter 180 for a selected position of switch 176 varies over the range of voltages selectable by the switch 24, it may be effected by adjustment of the associated resistors 166–170. Thus, the resistor 200 may be adjusted to effect a constant change in the indicated voltage at all positions of switch 176; the voltage taps 166–170 may be adjusted to effect a constant change in the indicated voltage at any one position of switch 176; and the resistors 171–175 may be adjusted to effect a variable change in the indicated voltage at one position of switch 176 for all the positions of switch 24. In this manner, fine tuning adjustments may be made in the indicated reading on voltmeter 180, when installing system 10, to compensate for unexpected variations in the indicated reading to bring it into conformity with the reading of actual voltage applied between cathode 94 and anode target 98 during an X-ray exposure.

Thus, there has been disclosed herein an X-ray generator system 10 having voltage indicator circuit provided with an adjustable resistor network electrically connected to the voltage supply circuit 12 and coupled to the current supply circuit 14 for indicating prior to an X-ray exposure the actual voltage applied between cathode and anode electrodes of X-ray tube 90 during the X-ray exposure, despite a voltage drop occurring in input power line 50 when the X-ray exposure is initiated.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in any limiting sense.

What is claimed is:

1. An X-ray generator system comprising:

control circuitry having input means disposed for electrical connection to an input power line and output means connectable electrically to an X-ray tube for operation thereof, said circuitry including voltage select means and current select means for applying an initial voltage and a selected current, respectively, to said output means; and voltage indicator means connected to the voltage select means and the current select means for indicating prior to operation of said tube actual voltage that will be applied to said X-ray tube during said operation, said voltage indicating means including voltage bucking means for subtracting from said initial voltage in accordance with said selected current an amount related to voltage losses in said control circuitry during said operation and including adjustable resistive means for subtracting from said initial voltage in accordance with said selected current an amount related to a voltage drop in said input power line during said operation of said X-ray tube, said adjustable resistive means including a network of adjustable resistors connected electrically in series with the voltage bucking means.

2. An X-ray generator system comprising:

an electrical circuit having input means disposed for electrical connection to an input power line and having an adjustable voltage source with output means connectable electrically to an X-ray tube for supplying a selected voltage during operation of said tube, the circuit also including voltage indicator means for indicating prior to operation of said tube an actual voltage that will be applied to said tube during operation thereof, said voltage indicator means comprising a transformer having a primary winding connected electrically to said input means of the circuit and having a secondary winding connected electrically to said output means of the adjustable voltage source, the secondary winding being provided with a plurality of voltage taps, a resistive network having a plurality of adjustable resistors, each being connected in electrical series with a respective one of said voltage taps, a selector switch having a movable contact and a plurality of fixed contacts, each of said fixed contacts being connected electrically in series with a respective one of said resistors, and a voltmeter connected electrically to said movable contact of the selector switch.

3. An X-ray generator system comprising:

a voltage supply circuit having input means disposed for electrical connection to an input power line and output means connectable electrically to an X-ray tube for operation thereof, said voltage supply circuit including voltage select means disposed for applying an initial voltage to said output means of said voltage supply circuit;

a current supply circuit having input means disposed for electrical connection to said input power line and output means connectable electrically to said X-ray tube for operation thereof, said current supply circuit including current select means disposed for applying a selected current to said X-ray tube; and voltage indicator means connected electrically to said voltage select means and coupled to said current select means for indicating in accordance with adjustment thereof an actual voltage applied to said X-ray tube during operation of said tube, said voltage indicator means having a resistive network including a plurality of adjustable resistors, each being adjusted for subtracting from said initial voltage a respective amount equivalent to a voltage drop in said input power line related to a respective associated selectable current drawn from said input power line during operation of said X-ray tube.

4. An X-ray generator system as set forth in claim 3 wherein said voltage indicator means includes voltage compensator select means connected electrically to respective adjustable resistors of said resistive network and coupled to said current select means for selecting a respective resistor of said network in accordance with adjustment of said current select means.

5. An X-ray generator system as set forth in claim 4 wherein said voltage compensator select means comprises a switch having a plurality of fixed contacts connected electrically to respective resistors of said network and sequentially engageable by a movable contact member which is coupled to said current select means for operation therewith.

6. An X-ray generator system as set forth in claim 4 wherein said voltage indicator means includes voltmeter means connected electrically in series with said voltage compensator select means for indicating said actual voltage applied to said X-ray tube.

7. An X-ray generator system comprising:

an adjustable voltage source having input means disposed for electrical connection to an input power line and having a pair of output conductors, said adjustable voltage source including voltage select means disposed for applying an initial voltage to said pair of output conductors;

an adjustable current source having input means disposed for drawing current from said input power line and having output means electrically connectable to an X-ray tube for operation thereof;

a high voltage source having output means electrically connectable to said X-ray tube for operation thereof and having input means electrically connectable to said pair of output conductors for producing a correspondingly higher output voltage than the initial voltage and initiating operation of said X-ray tube; and voltage indicator means connected electrically between said pair of output conductors for indicating prior to said initiating operation of said X-ray tube an actual high voltage applied to said X-ray tube during operation thereof, said voltage indicator means having voltage subtracting means coupled to said current select means for subtracting amounts from said initial voltage in accordance with said selected current, said voltage subtracting means including voltage bucking means disposed for subtracting from said initial voltage an amount related to voltage losses in said high voltage source and said tube during operation of said tube and including independently adjustable voltage dropping means disposed in electrical series with the voltage bucking means for further subtracting from said initial voltage an amount equivalent to power losses in said adjustable voltage source related to current drawn from the input power line during operation of said X-ray tube.

said voltage bucking means comprises a voltage compensator transformer including a secondary winding having terminal conductor means connected electrically to one of said pair of output conductors for impressing said selected voltage in a graduated series of values along said secondary winding in one direction, and including primary winding means disposed for inducing a bucking voltage in a graduated series of values along said secondary winding in an opposite direction, said secondary winding also being provided with an adjustable series of spaced secondary taps having applied thereto respective resultant voltages representative to said selected voltage reduced by current related voltage losses in said high voltage source and said X-ray tube.

8. An X-ray generator system as set forth in claim 7 wherein said voltage dropping means comprises a resistive network including a plurality of adjustable resistors, each being connected in electrical series with one of said secondary taps and provided with an adjustable resistor tap having applied thereto an actual voltage representative of the input resultant voltage further reduced by a current related voltage drop in said input power line.

9. An X-ray generator system as set forth in claim 8 wherein said voltage subtracting means includes a voltage compensator select switch having a plurality of fixed contacts insulated from one another and connected electrically to respective taps of said adjustable resistors, and having a movable contact member disposed for sequentially engaging each of said fixed contacts and coupled to said current select means for corresponding adjustment therewith.

10. An X-ray genreator system as set forth in claim 9 wherein said voltage indicating means includes voltmeter means connected in electrical series with said movable contact of said voltage compensator select means for indicating said actual voltage value.

11. An X-ray generator system as set forth in claim 10 wherein said voltage indicating means includes adjustable resistor means connected electrically in series with said one of said pair of output conductors for adjusting said actual voltage applied to said X-ray tube relative to said voltmeter indicated actual voltage value.

12. An X-ray generator system as set forth in claim 10 wherein said primary means of said voltage compensator transformer includes adjustable input conductor means for adjusting said voltmeter indicated actual voltage value relative to said actual voltage applied to said X-ray tube.

* * * * *